US006858292B2

(12) United States Patent
Kendall

(10) Patent No.: US 6,858,292 B2
(45) Date of Patent: Feb. 22, 2005

(54) ABRASIVE ARTICLES WITH RESIN CONTROL ADDITIVES

(75) Inventor: Philip E. Kendall, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 28 days.

(21) Appl. No.: 10/236,588

(22) Filed: Sep. 6, 2002

(65) Prior Publication Data

US 2004/0048057 A1 Mar. 11, 2004

(51) Int. Cl.[7] ..... B32B 5/16

(52) U.S. Cl. ..... 428/323; 428/325; 428/327; 428/328; 428/330; 51/295; 51/293; 51/298; 51/297; 51/307; 51/309

(58) Field of Search ..... 428/323, 325, 428/327, 328, 330; 51/295, 293, 298, 297, 307, 309

(56) References Cited

U.S. PATENT DOCUMENTS

| | | | | |
|---|---|---|---|---|
| 4,609,380 | A | | 9/1986 | Barnett et al. |
| 4,988,554 | A | | 1/1991 | Peterson et al. |
| 5,273,558 | A | | 12/1993 | Nelson et al. |
| 5,389,168 | A | | 2/1995 | Litchholt et al. |
| 5,492,550 | A | | 2/1996 | Krishnan et al. |
| 5,551,962 | A | | 9/1996 | Ho |
| 5,840,090 | A | | 11/1998 | Ho et al. |
| 5,908,477 | A | | 6/1999 | Harmer et al. |
| 5,919,549 | A | | 7/1999 | Van et al. |
| 5,928,070 | A | | 7/1999 | Lux |
| 6,179,887 | B1 | * | 1/2001 | Barber, Jr. ..... 51/298 |
| 6,228,133 | B1 | * | 5/2001 | Thurber et al. ..... 51/295 |
| 6,261,156 | B1 | | 7/2001 | Johnson et al. |
| 6,261,682 | B1 | | 7/2001 | Law |
| 6,293,980 | B2 | | 9/2001 | Wei et al. |
| 6,302,930 | B1 | | 10/2001 | Lux |
| 6,361,828 | B1 | | 3/2002 | Tomaru et al. |
| 6,372,336 | B1 | | 4/2002 | Clausen et al. |
| 6,413,287 | B1 | * | 7/2002 | Barber, Jr. ..... 51/298 |
| 2001/0011108 | A1 | | 8/2001 | Thurber et al. |
| 2002/0002026 | A1 | | 1/2002 | Molnar |
| 2002/0014040 | A1 | | 2/2002 | Vincent |
| 2002/0026752 | A1 | | 3/2002 | Culler et al. |
| 2002/0123548 | A1 | | 9/2002 | Thurber et al. |

FOREIGN PATENT DOCUMENTS

| | | |
|---|---|---|
| WO | WO 97/14534 | 4/1997 |

* cited by examiner

*Primary Examiner*—Leszek B Kiliman

(57) ABSTRACT

The present invention is directed to abrasive articles comprising a resin transfer additive and methods of abrading a workpiece with the abrasive article. The resin control additive is a metal salt of a long chain fatty acid. The abrasive article comprises a backing having a major surface, and an abrasive layer secured to at least a portion of the major surface. The abrasive layer comprises a binder, abrasive particles distributed in the binder, and a resin control additive distributed in the binder, and wherein the abrasive layer has a substantially uniform thickness.

23 Claims, 3 Drawing Sheets

ABRASIVE ARTICLES WITH RESIN CONTROL ADDITIVES

FIELD OF THE INVENTION

This invention relates to an abrasive article comprising a resin control additive, and to methods for the use of such an article. The article is useful as a polishing film, for example for polishing the exposed ends of a fiber optic connector.

BACKGROUND OF THE INVENTION

Many different types of abrasive articles exist in the art. These include coated abrasives, non-woven abrasives and bonded abrasives. Each type of abrasive article is designed for a specific use. For example, a specific type of a coated abrasive is a lapping film. Lapping films may be used in abrasive processes requiring a fine finish without excessive heat generation. One example is the polishing of fiber optic connectors.

Fiber optic connectors of a wide variety of designs have been employed to terminate optical fiber cables and to facilitate the connection of the cables to other cables or other optical fiber transmission devices. A typical optic fiber connector includes a ferrule, which mounts and precisely positions an optical fiber or fibers within the connector. The ferrule may be fabricated of ceramic materials.

A typical single mode fiber optical connector may include a glass core with an outer diameter of about 9 microns surrounded by a glass cladding with an outer diameter of about 125 microns (collectively the "glass fiber"). A ferrule then surrounds the glass fiber. The ferrule has an outer diameter of about 2.0 millimeters at its outer ends and the diameter increases along a beveled edge (approximately 45°) to about 2.5 millimeters at its widest portion. During manufacture, the glass fiber is threaded through the ceramic ferrule and attached with an epoxy resin. The excess glass is then cleaved from the newly formed fiber optical connector, and the ends are polished to a fine finish.

A pair of fiber optic connectors or a connector and another optical fiber transmission device often are mated in an adapter that aligns the fibers to provide good transmission. The adapter couples the connectors together so that their encapsulated fibers connect end-to-end to permit the transmission of light. The adapter may be an in-line component, or the adapter may be designed for mounting in an opening in a panel, backplane, circuit board or the like.

The polishing of the connectors is a necessary and important step. Light travels through the glass fiber across the junction to the next connector. In order to achieve a good transmission of the light, the ends must be highly polished, and the polished ends of the glass fiber and the ceramic ferrule may lie within a common planar or slightly convex surface. A planar or slightly convex surface with a radius of curvature of between about 10 millimeters and about 20 millimeters gives maximum glass fiber core contact area with the glass fiber core in the adjacent connector. With good transmission of light across the junction, the backreflection of the connection, a measure of the amount of light lost across the junction, will be minimized.

Single mode fiber optic connectors are currently finished with a series of abrasive lapping films, most commonly starting with a coarse grade of silicon carbide, then several progressively finer grades of diamond, and finally a very fine grade of silica. The finishing of the connectors requires very precise cutting properties at each step so that the geometry of the fiber optic remains optimal, and at the same time requires that the polished connector have no defect flaws such as scratches, pits, or deposits. One common deposit on connectors is known in the industry as "resin transfer". The source of the resin in not well known, it may be from the lapping films, from the epoxy used in creating the connector, or a combination of both. It presents itself, however, as a smear that can be readily seen at 200× under an optical microscope.

Resin transfer may be affected by the binder chosen and the combination of the binders. Additionally, the level of cure of a binder has an effect on resin transfer. Resin transfer can also be affected at the end user level, for instance by the use of isopropanol/water or soap/water blends as a working liquid. This is a generally undesirable means of control, however, for a lapping film vendor because many end users have a strong preference to simply use water since a water-only system is more environmentally friendly. Resin transfer can also be affected by the polishing conditions employed, but usually cannot be controlled by these parameters. In any case, this is also undesirable for lapping film vendors, because each fiber optic polishing operation is slightly different, requiring different optimal processes, which the end user may be unwilling or unable to follow.

The invention involves the addition of additives to abrasive article such that the use of the modified abrasive article exhibits substantially less resin transfer.

SUMMARY OF THE INVENTION

It is desirable to overcome the shortcomings of prior polishing articles and methods and to create a polishing article that will polish fiber optic connectors over a wide range of conditions while minimizing resin transfer.

In one aspect, the present invention is directed to an abrasive article comprising a backing having a major surface; and an abrasive layer secured to at least a portion of the major surface wherein the abrasive layer comprises a binder, abrasive particles distributed in the binder, and particles comprising a resin control additive and essentially free of inorganic nonabrasive particles distributed in the binder, and wherein the abrasive layer has a substantially uniform thickness.

In another aspect, the present invention is directed to an abrasive article comprising a backing having a major surface; and an abrasive layer secured to at least a portion of the major surface wherein the abrasive layer comprises a binder, abrasive particles distributed in the binder, and a resin control additive molecularly distributed in the binder, and wherein the abrasive layer has a substantially uniform thickness.

In another aspect, the present invention is directed to an abrasive article comprising a backing having a major surface; and an abrasive layer secured to at least a portion of the major surface wherein the abrasive layer comprises a binder, abrasive particles having a mean particle size distributed within the binder, and particles comprising a resin control additive having a mean particle size greater than about 2 times the abrasive particles mean particle size, and wherein the abrasive layer has a substantially uniform thickness.

The present invention is also directed to a method of abrading a workpiece comprising providing an abrasive article comprising a backing having a major surface and an abrasive layer secured to at least a portion of the major surface wherein the abrasive layer comprises a binder, abrasive particles distributed in the binder, and a resin control additive distributed in the binder, and wherein the abrasive layer has a substantially uniform thickness; contacting the abrasive article with a polishing surface of the workpiece; and relatively moving the workpiece and the abrasive article.

The above summary of the invention is not intended to describe each disclosed embodiment or every implementation of the present invention. The Figures and the detailed description, including examples, more particularly exemplify illustrative embodiments.

DETAILED DESCRIPTION

Figure 1:
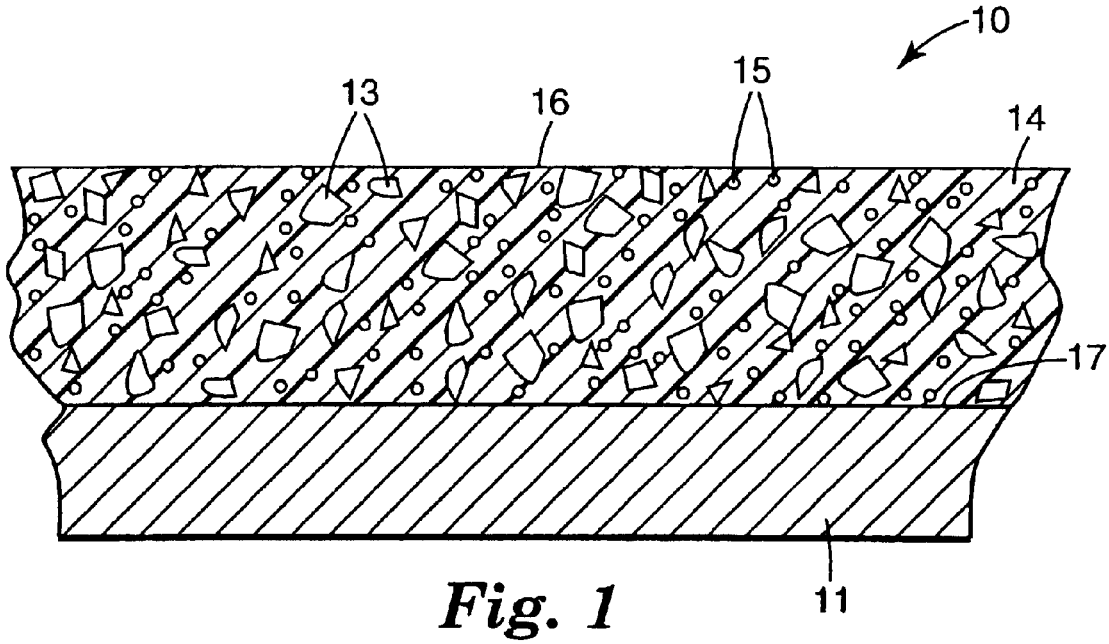
FIG. 1 is a cross-sectional view of an embodiment of an abrasive article of the present invention.
Figure 2:
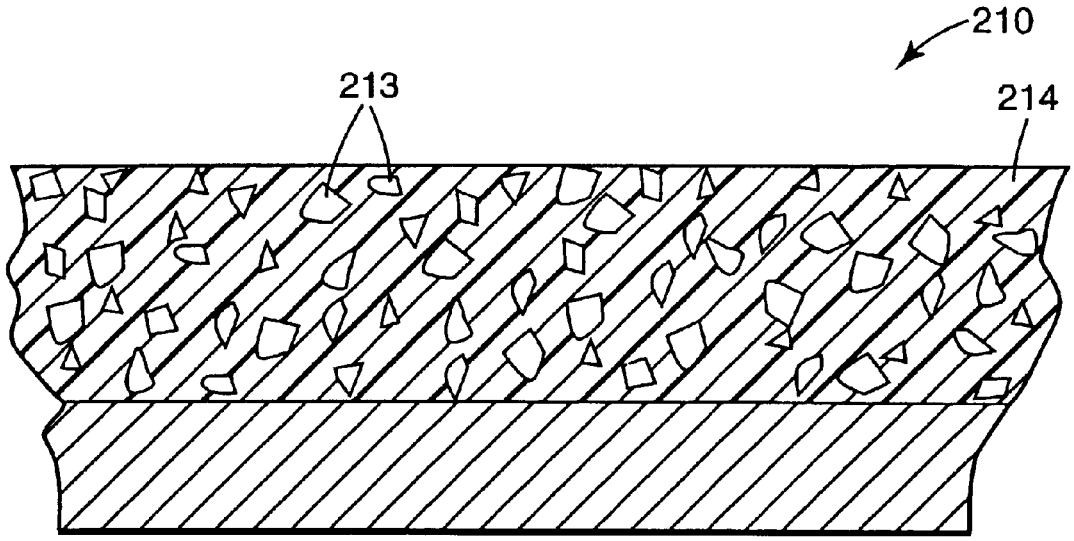
FIG. 2 is a cross-sectional view of another embodiment of an abrasive article of the present invention.
Figure 3:
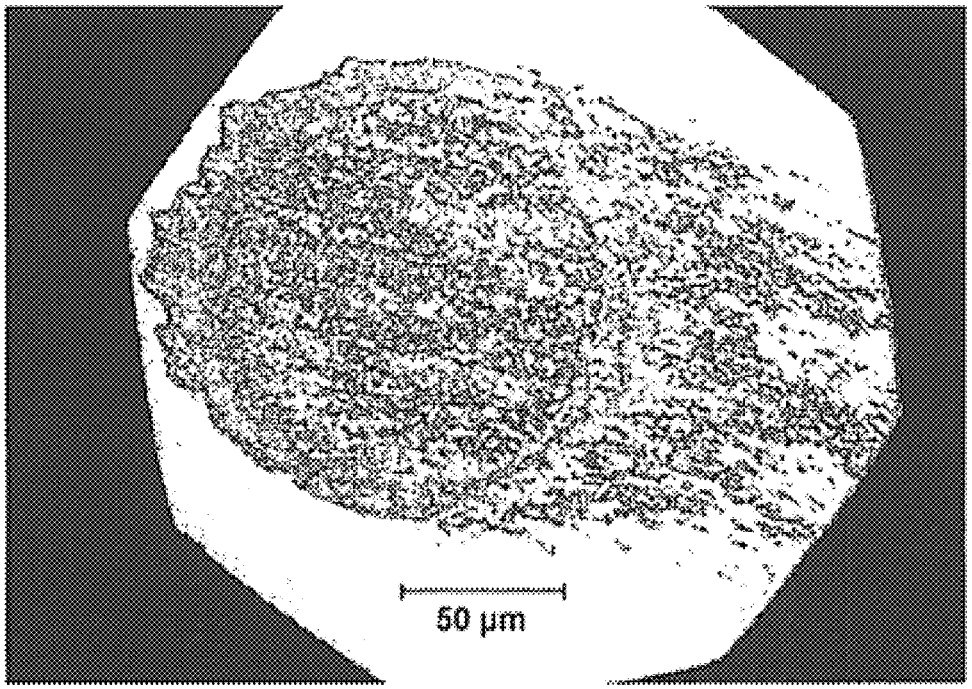
FIGS. 3–6 are optical micrographs of a fiber optic connector after the Fiber Optic Test described below.
Figure 4:
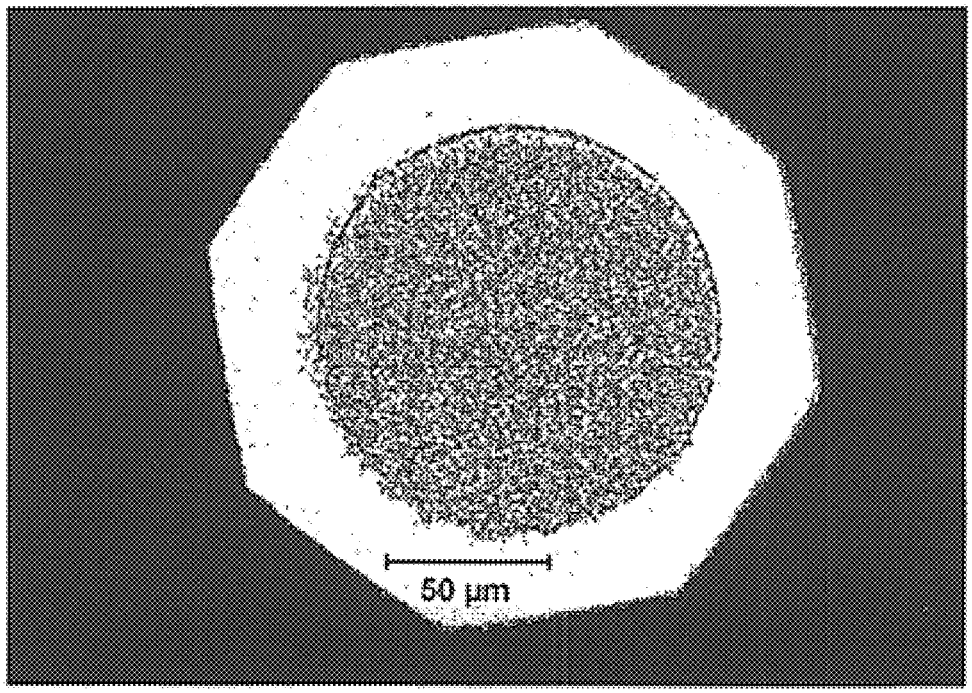
Figure 5:
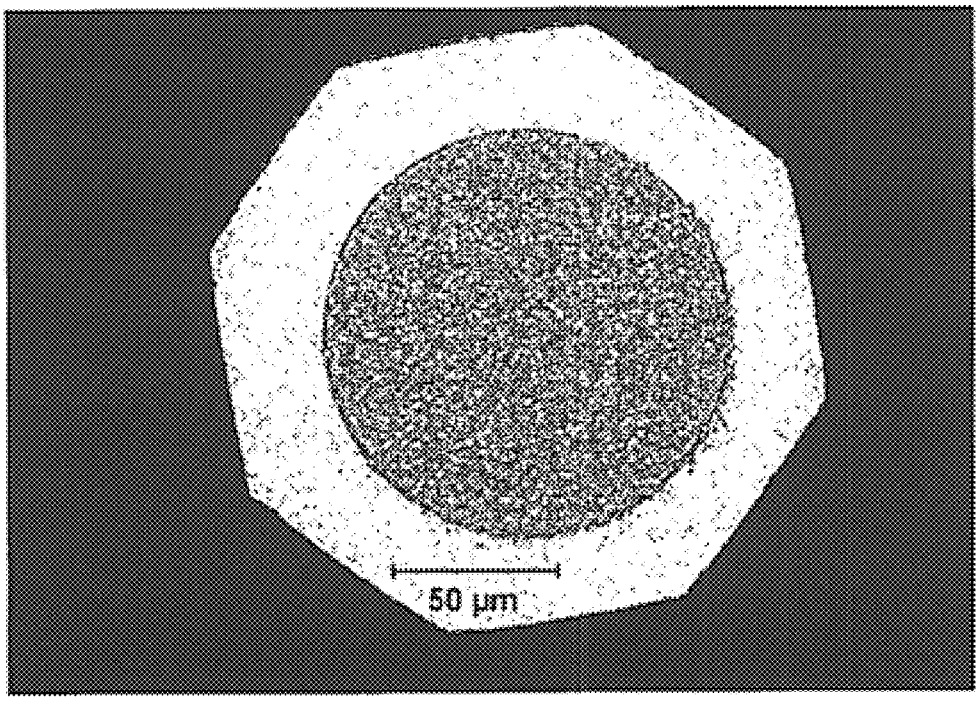
Figure 6:
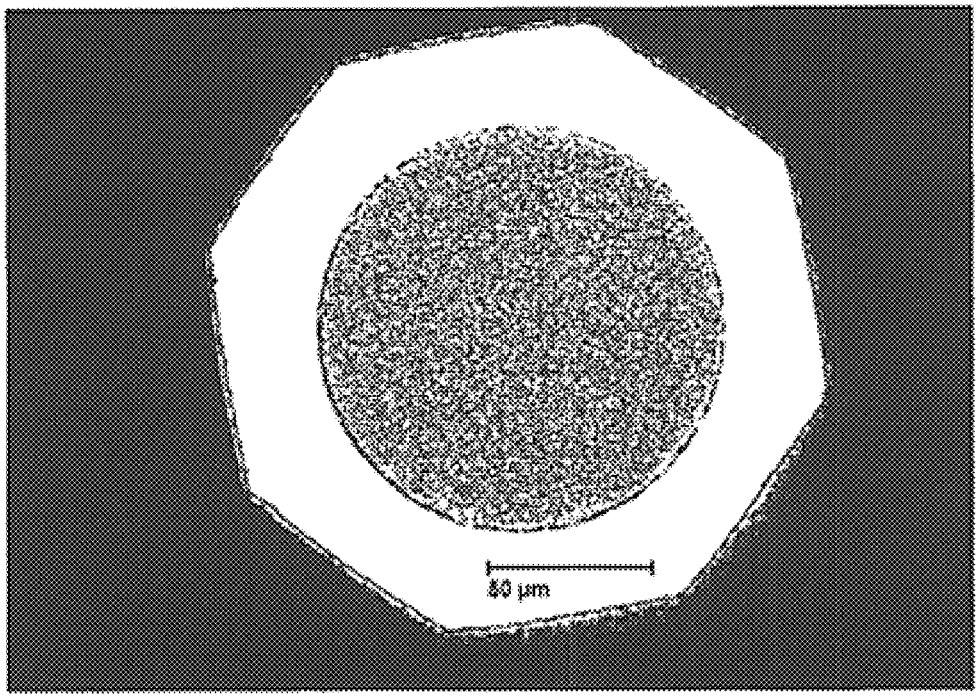

FIG. 1 is an embodiment of an abrasive article 10. The abrasive article 10 has a backing 11 having a major surface 17. An abrasive layer 16 bonded to at least a portion of the major surface 17 of the backing. The abrasive layer 16 comprises a mixture of a plurality of abrasive particles 13, a binder 14 and a resin transfer additive 15. The resin transfer additive 15 is in particulate form. As discussed later, the resin control additive may have a mean particle size that is less than or greater than (not shown) the mean particle size of the abrasive particle 13. The binder 14 serves also to bond the abrasive layer 16 to the front surface 17 of the backing 11. The abrasive particles and the resin transfer additive are essentially uniformly dispersed throughout the binder. FIG. 2 is a second embodiment of an abrasive article 210 having abrasive particles 213, wherein the resin transfer additive is molecularly dispersed within the binder 214.

The abrasive layer has a substantially uniform thickness. For the purpose of the present invention, substantially uniform thickness is defined as the variation in the dry abrasive layer from the highest point to the lowest point of no greater than about 50 micrometers. For example, the variation is no greater than about 20 micrometers. In specific examples, the variation is no greater than about 15 micrometers, for example no greater than about 10 micrometers. In exemplary embodiments, the variation is no greater than about 5 micrometer, for example no greater than about 2 micrometers. Generally the abrasive layer has a total dry thickness of no greater than about 50 micrometers at any point, for example no greater than about 20 micrometers. In specific examples, the abrasive layer has a total dry thickness no greater than about 15 micrometers, for example no greater than about 10 micrometers. In exemplary embodiments, the abrasive layer has a total dry thickness of no greater than about 5 micrometers, for example between about 2 and about 5 micrometers.

The backing may be of any material suitable as a backing for a coated abrasive article. For example, the backing may be a flexible polymeric film, such as polyethylene terephthalate film. The backing may have a thickness of about 25 microns to about 178 microns. Preferably the backing has a thickness of about 50 microns to about 130 microns, most preferably about 75 to about 77 microns. Suitable backings include polyester films such as those described in the Examples herein.

The binder used in the article of the invention may be any material used to form a film. Generally, the binder is an organic binder formed from a binder precursor. The binder precursor is typically in a flowable state. During the manufacture of the abrasive article, the binder precursor is then converted to a hardened binder in the manufactured abrasive article. The binder is typically in a solid, non-flowable state in the manufactured abrasive article. The binder can be formed from a thermoplastic material. Alternatively, the binder can be formed from a material that is capable of being crosslinked. It is also within the scope of this invention to have a mixture of a thermoplastic binder and a crosslinked binder. During the process of making the abrasive article, the coating solution is exposed to the appropriate conditions to solidify the binder. For thermoplastic binder, the binder is exposed to an appropriate energy source to evaporate any carrier liquid to dry the binder. Thus, the binder becomes solid. For crosslinkable binders, the binder precursor is exposed to the appropriate energy source to evaporate any carrier liquid and/or initiate the polymerization or curing and to form the binder. Thus after curing, the coating solution is converted into a binder.

A crosslinkable binder's precursor can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

In the present invention, suitable binders include thermoplastic polyols or an isocyanate crosslinked polyol network. The polyol can be a small molecule such as bisphenol A, or a large molecule such as a polymeric polyol. Suitable binders may use one polyol crosslinked by the isocyanate or a mixture of polyols. The mixture may additionally contain monofunctional alcohols. The isocyanate is then added in to a level sufficient to provide effective crosslinking and curing. Examples of suitable polyols include condensation products of bisphenol A and glycols, such as those commercially available under the trade name SYNFAC 8024 from Milliken Corp., Spartansburg, S.C., and a solid phenoxy resin having the trade designation of YP-50S obtained from Tohto Kasei Co. Ltd., Inabata America Corp., New York, N.Y. which is then dissolved at 30% solids in 2-butanone prior to use herein. Suitable isocyanate resins include those having the trade designations of CB55N and MONDUR MRS from Bayer Corp. of Pittsburgh, Pa. Another form of polymeric polyol for use in a polyol blend are polyester urethane resins. A suitable polyester urethane rein is prepared from 6% by weight neopentyl glycol, 31% by weight 4,4'-diphenyl methane diisocyanate (MDI), and 63% by weight poly-ϵ-caprolactone in 2-butanone. In a specific embodiment, the binder comprises a combination of phenoxy resin, isocyanate resin and polyester urethane resin.

The above mentioned examples of binders are a representative showing of binders, and not meant to encompass all binders. Those skilled in the art may recognize additional binders that may be used within the scope of the invention.

There are two main types of abrasive particles, inorganic abrasive particles and organic based particles. The inorganic abrasives particles can further be divided into hard inorganic abrasive particles (i.e., those having a Mohs hardness greater than 8) and soft inorganic abrasive particles (i.e., those having a Mohs hardness less than 8). Examples of conventional hard abrasive particles include fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles and the like. Examples of sol gel abrasive particles can be found in U.S. Pat. Nos. 4,314,827, 4,623,364; 4,744,802, 4,770,671; and 4,881,951.

Examples of conventional softer inorganic abrasive particles include silica, iron oxide, chromia, ceria, zirconia, titania, silicates and tin oxide. Still other examples of soft abrasive particles include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), γ-aluminum oxide, titanium dioxide) and metal sulfites (such as calcium sulfite), metal particles (tin, lead, copper and the like) and the like.

The organic based abrasive particles can be formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon and combinations thereof. In general, some useful thermoplastic polymers are those having a high melting temperature or good heat resistance properties. There are several ways to form a thermoplastic abrasive particle known in the art.

The abrasive article may also contain a mixture of two or more different abrasive particles. This mixture may comprise a mixture of hard inorganic abrasive particles and soft inorganic abrasive particles or a mixture of two soft abrasive particles. In the mixture of two or more different abrasive particles, the individual abrasive particles may have the same average particle size, or alternatively the individual abrasive particles may have a different average particle size. In yet another aspect, there may be a mixture of inorganic abrasive particles and organic abrasive particles.

The abrasive particle can be treated to provide a surface coating thereon. Surface coatings are known to improve the adhesion between the abrasive particle and the binder in the abrasive article. Additionally, the surface coating may also improve the dispersibility of the abrasive particles in the coating solution. Alternatively, surface coatings can alter and improve the cutting characteristics of the resulting abrasive particle.

Generally, the abrasive particles used in the articles of the present invention are diamond, silicon carbide or silica particles. Generally, diamond and silicon carbide are useful in a pre-polish step when preparing the fiber optic connector for a final polish step. Silica is generally used when the article of the invention is to be used in the polishing of fiber optic connectors, as described herein. In some embodiments, the silica particle has a mean particle size diameter of less than 20 nanometers. In some embodiments, the silica particle has a mean particle size diameter of about 12 nanometers. In exemplary embodiments, the diamond particle has a mean particle size diameter of less than about 10 micrometers. For example, the mean particle size of the diamond may be less than or equal to about 5 micrometers, such as less than or equal to about 1.5 micrometers. In certain embodiments, the diamond particles have a mean particle size of between about 0.4 and about 1 micrometer. The above mentioned examples of abrasive particles are meant to be a representative showing, and not meant to encompass all abrasive particles. Those skilled in the art may recognize additional abrasive particles that can be incorporated into the abrasive article within the scope of the invention.

A resin control additive is distributed within the binder. A resin control additive is defined, for the purpose of the present invention, as a metal salt of a long chain fatty acid. A long chain fatty acid is defined as a saturated or unsaturated $C_{12}$–$C_{24}$ acid. Examples of suitable long chain fatty acids include lauric acid, oleic acid, myristic acid, stearic acid, linoleic acid and the like. Examples of metals used in the metal salts may include, but are not limited to, transition metals and alkali and alkaline earth metals. Specific examples of suitable metals include zinc, lithium, sodium, calcium, potassium, magnesium and the like. Examples of suitable resin control additives include lithium stearate, sodium stearate, calcium stearate and other divalent metal stearates.

The resin control additive may be a solid particle with a maximum mean size of less than about 80 micrometers, for example no greater than about 20 micrometers. The some examples, the maximum mean size is no greater than about 15 micrometers. In specific embodiments, the resin control additive is a particle with a maximum mean size of no greater than about 10 micrometers. Generally, the resin control additive particle is greater than about 1 micrometer, for example greater than about 3 micrometers. In other embodiments, the resin control additive is molecularly dispersed, i.e. not in particle form, within the binder. In many examples, the particle comprising the resin control additive is more than 2 times the size of the abrasive particles, for example more than 3 times the size of the abrasive particles. For example, if the abrasive particle has a mean particle size of between about 0.4 and about 1 micrometer, the particle comprising the resin control additive may be greater than 2 micrometers, for example greater than 3 micrometers.

In certain embodiments, the particle comprising the resin control additive is essentially free of inorganic nonabrasive grains. Inorganic nonabrasive grains are, for example, those defined in U.S. Pat. No. 5,840,090 to Ho et al. Included in this definition are metal carbonates, potassium tetrafluoroborate ($KBF_4$), sodium cryolite ($Na_3AlF_6$), sodium metaphosphate ($NaPO_3$), sodium chloride, potassium cryolite, ammonium cryolite, sodium tetrafluoroborate, silicon fluoride, potassium chloride, magnesium chloride, metals, sulfur, graphite, metallic sulfides, calcium magnesium carbonate, sodium carbonate, magnesium carbonate, metal sulfates, gypsum, vermiculite, aluminum trihydrate, metal oxides, and metal sulfites. Essentially free of inorganic nonabrasive grains is defined as the particle is less than about 5% by weight inorganic nonabrasive grains, for example less than about 3% by weight inorganic nonabrasive grains. In some embodiments, the particle has less than about 1% by weight inorganic nonabrasive grains, for example 0% by weight inorganic nonabrasive grains. In some embodiments, the particles consist essentially of the resin control additive.

The resin control additive may form up to about 4% by weight of the abrasive layer. In certain embodiments, the resin control additive composes less than about 2% by weight, for example less than about 1% by weight of the abrasive layer. In certain embodiments, the resin control additive comprises between about 0.2% by weight and about 0.8% by weight of the abrasive layer while still achieving the goals of the present invention.

Optional additives, such as, for example, fillers (including grinding aids), fibers, antistatic agents, lubricants, wetting agents, surfactants, pigments, dyes, coupling agents, plasticizers, release agents, suspending agents, and curing agents including free radical initiators and photoinitiators, may be included in the binder precursor and in the resulting abrasive articles of the present invention. These optional additives may further require that additional components be included in the coating solution composition to aid in curing; for example, a photoinitiator may be required when acrylates are used. The amounts of these materials can be selected to provide the properties desired.

The abrasive article of the present invention is manufactured by applying a coating solution to a backing. The coating solution comprises a binder precursor, abrasive particles, and a resin control additive. Generally, the coating solution additionally includes a solvent to form a liquidus slurry. The coating solution is then solidified to provide the abrasive article. The coating solution may be applied to the backing by any suitable means for spreading a thin coat, such as by a knife coater, a spray coater, or a roll coater for example. As discussed above, the binder, abrasive and resin control additive may be any of a number of materials described herein.

After it is applied to the backing, the coating solution composition may be solidified by curing or evaporating any carrier liquid by exposure to thermal energy or a radiation energy source, such as ultraviolet radiation.

The article of the present invention can be used to abrade and/or polish a wide range of contact surfaces. The contact surface may be flat or may have a shape or contour associated with it. Examples of specific contact surfaces include ophthalmic lenses, glass television screens, fiber optic connectors, ceramics, glass, stone, bath tubs, showers, sinks, and the like. The contact surface may also be a composite article. A composite article has both resinous components and glass or ceramic components present on the surface.

The abrasive article of the invention can be used by hand or used in combination with a machine. For example, the abrasive article may be secured to a random orbital tool or a rotary tool. At least one or both of the abrasive article and the contact surface is moved relative to the other while maintaining contact.

In a specific example, the abrasive article may be useful in optical component polishing. An optical component is defined as any part of an optical device that alters the properties of an incoming optical signal, redirects or transmits the signal. Examples of optical components include, but are not limited to lenses, collimators, gradient index lenses, optical fibers, an array of optical fibers, couplers, waveguides, polarizers, Faraday rotators, fiber gratings, polarizing crystals, garnet crystals, cross connects and splitters. An optical device is any device that combines one or more optical components to alter the properties of the optical signal, redirect or transmit the signal. For example, fiber optic connectors, emitters, transmitters, repeaters, receivers, modulators, attenuators, couplers, isolators, amplifiers, waveguides, multiplexers, demultiplexers, routers and switches are all optical devices under this definition. Examples of other optical components and optical devices can be found in *The Photonics Buyers' Guide*, Book 2, 2001 Edition, Laurin Publishing, Pittsfield, Mass.

Optical components may be formed from many different materials. For example, the optical component may be silicon, a doped silicon material or silica glass. The optical component may also be doped silica, for example a rare earth doped silica, erbium doped silica, germanium doped silica, or erbium ytterbium doped silica. Other examples include gallium arsenide, indium gallium arsenide, germanium, indium gallium arsenide phosphide, fluorozirconate, indium phosphide, electro-optic switching material such as lithium niobate and potassium dihydrogen phosphate, solid state laser media such as ruby and Alexandrite, calcite, garnet, or rare earth doped garnet. Some optical devices are formed from ceramic surfaces, including calcium titanate, ceria-zirconia, or aluminum oxynitride.

The abrasive article is positioned between a support and the workpiece surface and pressure is applied by the support so that contact is made between the abrasive member and the workpiece surface. The support may be any known lapping, single side flat lapping or polishing machine. The support may include a soft back-up pad with a durometer of about 40 to about 90 Shore A. In other embodiments, the support may include a hard backing, such as materials with a durometer of over 100 Shore A, for example glass, plastics or metal. The abrasive article and the workpiece surface are moved relative to one another to finish the surface. The abrasive may either rotate on the workpiece surface or oscillate back and forth over the workpiece surface, or both. Generally, the abrasive moves over the workpiece between about 20 and about 300 times per minute to achieve a desired surface. The resultant surface may be a certain desired shape, such as a flat surface or may have a radius of curvature. The resultant surface may also be a desired surface finish. In one example, a lithium niobate polish, the desired surface finish appears scratch-free to the human eye at a magnification of 100 times.

In some embodiments, the abrasive may be conditioned prior to use. In a conditioning step, the top layers of the abrasive article, generally rich in binder, are removed. In order to accomplish this objective, the abrasive must be put in contact with a conditioning pad, such as an additional abrasive article, which will move against the abrasive and remove a layer of the surface. The conditioning step exposes abrasive particles so that polishing begins as soon as the abrasive article comes into contact with the workpiece.

Depending upon the application, there may be a working liquid present at the interface between the abrasive article and the workpiece. This liquid can be water and/or an organic solvent together with other optional components. The abrasive article may oscillate at the polishing interface during use.

Depending upon the particular application, the force exerted by the abrasive article on the contact surface at the abrading interface can range from about 0.1 N to over 100N, typically between 1N to 50N. For example, the force at the abrading interface is about 1N to about 40N for abrading twelve ST style single mode UPC ceramic optical connectors (available from Minnesota Mining and Manufacturing Company, St. Paul, Minn. under part description AAMAM-AT00.5), such as about 15N to about 30N. Also depending upon the application, there may be a liquid present at the interface between the abrasive article and the contact surface. This liquid can be water and/or an organic solvent. The liquid may further comprise additives such as lubricants, oils, emusilified organic compounds, cutting fluids, soaps, and the like. The abrasive article may oscillate at the polishing interface during use. In some embodiments, the abrasive article oscillates in an orbital fashion.

Generally, the abrasive article is rotated at about 100 to about 150 rpm, for about 1 minute while the lapping interface is rinsed with a working liquid.

In many uses, for example in a method of polishing a fiber optic connector, the substrate may be exposed to multiple polishing steps. In some embodiments, the abrasive article used in the first polishing step will comprise a resin transfer additive. In other embodiments, an abrasive article comprising a resin transfer additive will be used in later steps. In other embodiments, the resin transfer additive is present in the abrasive articles used in all steps.

The following examples further disclose embodiments of the invention.

EXAMPLES

Flat Lap Test:

Two pieces of metal carbide (commercially available as #STB-28A, from Kennametal, Lisle, Ill.) with the dimensions of 0.0625 in×0.25 in×1 in (0.16 cm×0.64 cm×2.54 cm) are glued with cyanoacrylate adhesive to the flat surface of a 0.25 in×1 in×1 in (0.64 cm×2.54 cm×2.54 cm) aluminum plate along the 0.0625 in×1" (0.16 cm×2.54 cm) edge, such that the glued carbide pieces are perpendicular to the metal plate and parallel to each other, and such that they are spaced 0.75 in (1.9 cm) apart. This workpiece is then weighed and mounted under a lever arm which presses the two metal carbide pieces against a 4.5 in×5 in (11.4 cm×12.7 cm) piece of lapping film such that the two metal carbide pieces are constantly flat against the lapping film. The lapping film, in turn, is clamped on a steel plate, which is driven by a motor and eccentric such that it moves in an orbital fashion. The eccentric is chosen to move the plate in a circular motion, with a travel of +/−0.75 in (1.9 cm) in the x and y directions on each revolution. The workpiece is pressed against the lapping film with a force of 5 lb (22.2 N). The base plate and lapping film are rotated for 5000 revolutions at 304+/−6 rpm while the lapping interface is being rinsed with 1–2 drops/sec of a 95/5 blend of de-ionized (DI) water and detergent (commercially available under the tradename Contrad 70, from Fisher Scientific, Pittsburgh, Pa.). At the end of the 5000 revolutions, the workpiece is removed, cleaned of residual lubricant and swarf, and reweighed. The difference in mg is reported as the cut observed for the sample.

Fiber Optic Test 1:

A set of 12 ST Fiber Optic Connectors (3M Co., Austin, Tex.) was prefinished on a Domaille Fiber Optic polisher (Domaille Co., Rochester, Minn.) with a sequence of 5 micrometer silicon carbide Lapping film (463X, 3M Co., St. Paul, Minn.), running the polisher with a 70 durometer pad and 8 lb force (35.6N) for 60 sec at 140 rpm using a mist of deionized water as a working liquid, 6 micrometer diamond lapping film (661X, 3M Co., St. Paul, Minn.), running the polisher with a 65 durometer pad and 4 lb force (17.8N) for 60 sec at 140 rpm using a mist of deionized water as a working liquid), and 3 micrometer diamond lapping film (661X, 3M Co., St. Paul, Minn.), running the polisher with a 70 durometer pad and 4 lb force (17.8N) for 60 sec at 140 rpm using a mist of deionized water as a working liquid). The fiber optic connectors were measured on a DORC Interferometer (Direct Optical Research Company, Phoenix, Ariz.) to assure a radius of curvature (ROC) in the range of 10–20 mm. The 6 micrometer diamond and 3 micrometer diamond steps were continued, if necessary, until the desired ROC was obtained.

The sample of 1 micrometer abrasive to be tested is then mounted on the Fiber Optic polisher over a 65 Durometer pad. A mist of de-ionized ("DI") water is applied as working liquid, the set of connectors is loaded onto the sample with 6 lb force (26.7N), and the polisher is run at 140 rpm for 60 sec. The set of connectors is removed and examined microscopically at 850× (Optispec Model ME2503, Optispec Microenterprises Inc., Norcross, Ga.) Resin transfer is observed as a smearing across the face of the connector, beginning at the fiber/ferrule interface in the case of mild transfer, and over the full face of the fiber and the ferrule in the case of severe resin transfer. Examples of resin transfer levels are shown in FIGS. 3 to 6. Each connector was rated as "No Resin Transfer"—0 (e.g. FIG. 6); "Very Light Resin Transfer"—1; "Light Resin Transfer"—2 (e.g. FIG. 5); "Moderate Resin Transfer"—3 (e.g. FIG. 4); "Heavy Resin Transfer"—4: or "Very Heavy Resin Transfer"—5 (e.g. FIG. 3). The number of connectors falling into each category was multiplied by the category value, and the sum of those numbers for the 12 connectors then becomes the "Resin Transfer Value" of that test. The test is run twice for each lot, and the average of the Resin Transfer Value is recorded as representing the lot. (Example—a set of 12 connectors was tested as described above. 3 connectors were observed to have "Very Light Resin Transfer", 1 Connector was observed to have "Light Resin Transfer", 2 Connectors were observed to have "Moderate Resin Transfer", 1 Connector was observed to have "Heavy Resin Transfer", and 1 Connector was observed to have "Very Heavy Resin Transfer". The Resin Transfer Value for the test was thus equal to ((4*0)+(3* 1)+(1*2)+(2*3)+(1*4)+(1*5))=(0+3+2+6+4+5)=20.)

Fiber Optic Test 2

A set of 12 SC Fiber Optic Connectors (Corning Co., Keller, Tex.) was prefinished on a Domaille Fiber Optic polisher (Domaille Co., Rochester, Minn.) with a sequence of 3 micrometer silicon carbide Lapping film (463X, 3M Co., St. Paul, Minn., running the Domaille with a 70 durometer pad and 4 lb force (17.8N) for 20 sec at 100 rpm. using a mist of deionized water as a lubricant.) followed by a 1 micrometer diamond lapping film (661X, 3M Co., St. Paul, Minn., running the polisher with a 70 durometer pad and 6 lb force (26.7N) for 30 sec at 100 rpm. using a mist of DI water as a working liquid.

The sample of the "silica polish" material to be tested is then mounted on the Fiber Optic polisher over a 70 Durometer pad. A mist of DI water is applied as working liquid, the set of connectors is loaded onto the sample with 6 lb. Force 926.7N), and run at 100 rpm for 60 sec. The set of connectors is removed and examined microscopically at 850× (Optispec Model ME2503, Optispec Microenterprises Inc., Norcross, Ga.). Resin transfer is observed as a smearing across the face of the connector, beginning at the fiber/ferrule interface in the case of mild transfer, and over the full face of the fiber and the ferrule in the case of severe resin transfer. The test value is recorded as the number of connectors that showed any discernable level of resin transfer.

Diamond Dispersion:

Approximately 40 $cm^3$ of 0.5 mm diameter beads (Yttria-stabilized zirconia, commercially available from Tosoh, Hudson, Ohio or from Toray Ceramics, George Missbach & Co., Atlanta, Ga.) were put into the basket of a Hockmeyer Basket Mill (Hockmeyer Equipment Corp., Harrison, N.J., Model HM-1/16 Air). 255 g of methylethylketone (MEK) were weighed into the mill container, followed by 16.5 g of a dispersant (commercially available under the tradename Solsperse 24000 from Avecia Pigments and Additives, Charlotte, N.C.). The mixture was stirred at low speed with an air stirrer until the dispersant had dissolved. Diamond powder (1100 g of General Electric Micron Products, Deerfield Beach, Fla., 0–2 micrometer SJK*-5C3M) was weighed into the mill chamber while stirring with the air mixer. When mixing was completed, the mill container was moved under the mill basket and motor, and the basket/motor were lowered to within 0.25 inch (0.64 mm) of the bottom of the mill. The mixture was milled at the maximum possible speed (without splashing over the side of the chamber) for 10 minutes. The mill contents were poured to a storage container, residual mill contents were washed into the container with MEK, the solids content of the container was determined (generally about 70%), and the container put aside for future use.

Examples 1–4 and Comparative Examples A–B

A mixing kettle was charged with 161.5 g methyl ethyl ketone ("MEK"), 147.2 g 1,3-dioxolane, and 26.6 g cyclohexanone. 10.2 g of a solution of 60% polyol (commercially available as SynFac 8024U from Milliken and Co., Spartansburg, S.C.) in MEK was added to the kettle, followed by 5.5 g of a solution of 50% surfactant (commercially available as Aerosol AY 50 surfactant from Cytec Industries, Boundbrook, N.J.) in MEK and 3.1 g of a dye. 180.5 g of Diamond Dispersion (125.8 g 1 micron GE Diamond, 1.9 g dispersant, and 52.8 g methyl ethyl ketone) was added to the kettle, and the mixture was stirred by hand. A polyester polyurethane resin (157.5 g of a 35% solution in MEK, the resin synthesized internally from neopentyl glycol [21%] poly-ϵ-caprolactone [29%] and a methylene diisocyanate (MDI) [50%]), and 87.6 g of a 30% solution of phenoxy resin (commercially available as YP-50S from Tohto Kasei Co. Ltd., Inabata America Corp., New York, N.Y.) in MEK. The resulting slurry was stirred for 10 minutes, and 20.2 g of a polymeric isocyanate based on diphenylmethane-diisocyanate (commercially available under the tradename Mondur MRS from Bayer Corp., Pittsburgh, Pa.) was blended into the kettle. The resulting dispersion was knife coated onto 3 mil (76 micron) polyethylene terephthalate film (commercially available from DuPont Teijin Films, Hopewell, Va.), at 30 ft/min (9.14 meter/min) with a 1.3 mil (33 micron) knife gap. The article was dried in a 200 ft (61 meter) long box oven at 225° F. (107° C.) and wound on a roll. The output roll from the oven was placed into another box oven at 165° F. (74° C.) for 24 hours, and the material was then removed and cooled to room temperature prior to testing.

In certain examples, an additive was added to the slurry prior to coating and drying. The additive was present at the level of 1.3 g/800 g of control slurry. In some embodiments, the mean particle size of the additive was measured using particle size analysis on a Horiba light scattering particle size analyzer (Horiba Instruments Company, Irvine, Calif., Model LA-910). The additive employed in a given example is detailed in Table 1:

TABLE 1

| Example | Additive (Mean Particle Size) | Source |
|---|---|---|
| Example 1 | Lithium Stearate (5 μm) | Witco Corp., Perth Amboy, NJ |
| Example 2 | Zinc Stearate | Witco Corp., Perth Amboy, NJ |
| Example 3 | Sodium Stearate (10 μm) | Witco Corp., Perth Amboy, NJ |
| Example 4 | Calcium Stearate (3.5 μm) | Witco Corp., Perth Amboy, NJ |
| Comp Ex. A | No Additive | |
| Comp. Ex. B | n-Butyl Myristate | Tokyo Kasei Kogyo Co., Ltd., Tokyo, Japan |

Each of the examples was coated and cured. The cured samples were then tested with the Flat Lap Test and Fiber Optic Test 1. The results of the tests are reported in Table 2.

TABLE 2

| Example | Resin Transfer Value | Cut (mg) |
|---|---|---|
| Example 1 | 0 | 30.3 |
| Example 2 | 0 | 21.9 |
| Example 3 | 0.5 | 28.0 |
| Example 4 | 0.5 | 23.4 |
| Comp. Ex. A | 10.0 | 31.9 |
| Comp. Ex. B | 11.0 | 28.8 |

Examples 5–6 and Comparative Examples C–E le;.5qA mixing kettle was charged with 865.3 g methyl ethyl ketone MEK (865.3 g), 1,3-dioxolane (736.8 g), and cyclohexanone (130.0 g). 51.0 g of the solution of the SynFac 8024U polyol was added, followed by 27.7 g of the solution of the Aerosol AY 50 surfactant and 15.7 g of a dye. 847.8 g of Diamond Dispersion (628.9 g 1 micron GE Diamond, 9.4 g dispersant, and 209.5 g MEK) was added to the kettle, and the mixture was stirred by hand. 788.0 g of the polyester polyurethane resin described above and 437.9 g of the phenoxy resin were added. The resulting slurry was stirred for 10 minutes and 101.0 g of the polymeric isocyanate described above was blended into the kettle. The resulting dispersion was split into specified aliquots. Experimental lots were then prepared by combining aliquots shown in Table 3 with a 10 weight % solution or dispersion of the respective additive in MEK also shown in Table 3.

The resulting dispersions were knife coated onto 3 mil (76 micron) polyethylene terephthalate film (DuPont Teijin Films, Hopewell, Va.), coating at 30 ft/min with a 1.3 mil (33 micron) knife gap, dried in a 200 ft (61 meter) long box oven at 225° F. (107° C.) and wound on a roll. The output roll from the oven was placed into another box oven at 165° F. (74° C.) for 24 hours, and the material was then removed and cooled to room temperature prior to testing.

The Examples, aliquots used, additives, additive amounts and their sources are as indicated below in Table 3:

TABLE 3

| Example | Dispersion Aliquot (g) | Additive | Amount (g) | Source |
|---|---|---|---|---|
| 5 | 225 | Sodium Oleate | 0.3211 | Aldrich Chemical Co., Milwaukee, WI |
| 6 | 250 | Lithium Stearate | 0.7500 | Witco Corp., Perth Amboy, NJ |
| Comp. Ex. C | 400 | Glycerol Trioleate | 0.6554 | Sigma Chemical Co., St. Louis, MO |
| Comp. Ex. D | 400 | Ammonium Oleate | 0.6221 | ICN Pharmaceuticals, Aurora, OH |
| Comp. Ex. E | 400 | No Additive | | |

The cured samples were then tested for cut using the Flat Lap Test, and for Resin Transfer using Fiber Optic Test 1. The results are reported in Table 4.

TABLE 4

| Example | Resin Transfer Value | Cut (mg) |
|---|---|---|
| 5 | 10 | 28.0 |
| 6 | 0 | 22.4 |
| Comp. Ex. C | 4.5 | 25.5 |
| Comp. Ex. D | 15.5 | 27.9 |
| Comp. Ex. E | 13.7 | 27.0 |

Although the "Resin Transfer Value" for Example 5 is not especially low, those connectors of Example 5 which did not exhibit resin transfer looked particularly good visually in terms of scratch, elimination of the epoxy ring, etc. This was not true of the Comparative Examples in this group.

Examples 7–9 and Comparative Example F:

A stainless steel mixing kettle was charged with 1412.5 g of a solution of colloidal silica in MEK (available from Nissan Chemical America Corp., Houston, Tex.), 129.9 g of 1,3-dioxolane, and 130.7 g toluene. A polyester polyurethane resin (105.2 g of a 25% solution in MEK, the resin synthesized internally from neopentyl glycol [6%] poly-ε-caprolactone [63%] and an methylene diisocyanate (MDI) [31%]), and "YP-50S" Phenoxy Resin (154.1 g) were then added sequentially. A 10% solution of dibutyltin dilaurate (Cardinal Chemical Co., Atofina Chemicals, Columbia, S.C.) was prepared in methyl ethyl ketone, and 1.0 g of the mixture added to the master batch. The master batch was ultrasonicated in a low power water bath for 15 minutes while stirred with an air mixer, and then Desmodur CB-55N isocyanate (75.6 g, Bayer Corp., Pittsburgh, Pa.) was added, followed by an additional 5 minutes of ultrasonication and stirring. Aliquots of 250 g were then taken from the master batch. One was knife coated directly as a control on to 3 mil (76 micron) DuPont Teijin polyethylene terephthalate film, coating at 30 ft/min (9.14 meter/min) with a 1.3 mil (33 micron) knife gap, dried in a 200 ft (61 meter) long box oven at 225° F. (107° C.) and wound on a roll. The output roll from the oven was placed into another box oven at 165° F. (74° C.) for 24 hours, and the material was then removed and cooled to room temperature prior to testing.

Examples were then prepared by combining a 250 g aliquot with a 10 weight % dispersion of calcium stearate in MEK. The resulting dispersion was then coated, dried, and cured at the same conditions used for the control.

The lot numbers and the amounts of calcium stearate dispersion added are indicated in table 5:

TABLE 5

| Example | Calcium Stearate Dispersion (g) |
|---|---|
| 7 | 0.9 |
| 8 | 1.6 |
| 9 | 3.2 |
| Comp. Ex. F | 0 |

The cured lapping films, both control and experimental, were tested using Fiber Optic Test 2. The results are reported in Table 6.

TABLE 6

| Example | No. Connectors with Resin Transfer |
|---|---|
| 7 | 0 |
| 8 | 2 |
| 9 | 0 |
| Comp. Ex. F | 5 |

Examples 7–9 additionally had visually superior finishes as compared to the Comparative Example F.

Various modifications and alterations of the present invention will become apparent to those skilled in the art without departing from the spirit and scope of the invention.

What is claimed is:

1. An abrasive article comprising a backing having a major surface; and an abrasive layer secured to at least a portion of the major surface wherein the abrasive layer comprises a binder, abrasive particles distributed in the binder, and particles comprising a resin control additive and essentially free of inorganic nonabrasive particles distributed in the binder, and wherein the abrasive layer has a substantially uniform thickness.

2. The abrasive article of claim 1 wherein the particles comprising a resin control additive have a mean particle size not greater than about 20 micrometers.

3. The abrasive article of claim 1 wherein the abrasive particles have a mean particle size, and particles comprising a resin control additive have a mean particles size greater than about 2 times the abrasive particles mean particle size.

4. The abrasive article of claim 1, wherein the particles comprising a resin control additive consists essentially of the resin control additive.

5. The abrasive article of claim 1, wherein the abrasive particles are diamonds.

6. The abrasive article of claim 1, wherein the abrasive particles are silica.

7. The abrasive article of claim 1, wherein the resin control additive is derived from zinc, lithium, sodium, calcium or magnesium.

8. The abrasive article of claim 1, wherein the resin control additive is derived from lauric acid, oleic acid, myristic acid, stearic acid or linoleic acid.

9. The abrasive article of claim 1, wherein the resin control additive is lithium stearate.

10. The abrasive article of claim 1, wherein the resin control additive is calcium stearate.

11. The abrasive article claim 1, wherein the resin control additive is sodium stearate.

12. The abrasive article of claim 1, wherein the backing comprises a polyester film.

13. The abrasive article of claim 1, wherein the binder comprises an organic binder.

14. An abrasive article comprising a backing having a major surface; and an abrasive layer secured to at least a portion of the major surface wherein the abrasive layer comprises a binder, abrasive particles distributed in the binder, and a resin control additive molecularly distributed in the binder, and wherein the abrasive layer has a substantially uniform thickness.

15. An abrasive article comprising a backing having a major surface; and an abrasive layer secured to at least a portion of the major surface wherein the abrasive layer comprises a binder, abrasive particles having a mean particle size distributed within the binder, and particles comprising a resin control additive having a mean particle size greater than about 2 times the abrasive particles mean particle size, and wherein the abrasive layer has a substantially uniform thickness.

16. The abrasive article of claim 15 wherein the abrasive particles have a mean particle size of between about 0.4 and about 1 micrometer, and the particles comprising a resin control additive have a mean particle size of greater than about 3 micrometers.

17. A method of abrading a workpiece comprising:

providing an abrasive article comprising a backing having a major surface and an abrasive layer secured to at least a portion of the major surface wherein the abrasive layer comprises a binder, abrasive particles distributed in the binder, and a resin control additive distributed in the binder, and wherein the abrasive layer has a substantially uniform thickness;

contacting the abrasive article with a polishing surface of the workpiece; and relatively moving the workpiece and the abrasive article.

18. The method of claim 17 wherein the workpiece is a composite article.

19. The method of claim 18 wherein the composite article is a fiber optic connector.

20. The method of claim 19 wherein the fiber optic connector is polished with the abrasive article for about 1 minute at between about 100 and about 150 rpm.

21. The method of claim 17, further comprising a second polishing step, the second polishing step comprising providing a second abrasive article comprising a backing having a surface and a coating on the surface, the coating comprising a binder and abrasive particles distributed in the binder, contacting the polishing surface with a second abrasive article and relatively moving the optical component and the abrasive article.

22. The method of claim 21, wherein the second polishing abrasive article comprises a resin control additive.

23. The method of claim 19 wherein the fiber optic connector exhibits a resin transfer value of no grater than 2.

* * * * *

UNITED STATES PATENT AND TRADEMARK OFFICE

CERTIFICATE OF CORRECTION

PATENT NO. : 6,858,292 B2
DATED : February 22, 2005
INVENTOR(S) : Kendall, Philip E.

It is certified that error appears in the above-identified patent and that said Letters Patent is hereby corrected as shown below:

Column 14,
Line 10, delete the word “particles” and insert in place thereof -- particle --.
Line 28, after “article” insert -- of --.

Column 16,
Line 10, delete the word “grater” and insert in place thereof -- greater --.

Signed and Sealed this

Nineteenth Day of July, 2005

JON W. DUDAS
*Director of the United States Patent and Trademark Office*